US006939166B2

(12) United States Patent
Chung

(10) Patent No.: US 6,939,166 B2
(45) Date of Patent: Sep. 6, 2005

(54) ELECTRICAL CONNECTOR CONNECTING WITH CABLES

(75) Inventor: Yung-Chien Chung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/998,885

(22) Filed: Nov. 29, 2004

(65) Prior Publication Data

US 2005/0118861 A1 Jun. 2, 2005

(30) Foreign Application Priority Data

Dec. 2, 2003 (TW) ..... 92221208 U

(51) Int. Cl.[7] ..... H01R 12/24
(52) U.S. Cl. ..... 439/495; 439/260; 439/573
(58) Field of Search ..... 439/495, 496, 439/497, 260, 67, 267, 492, 573

(56) References Cited

U.S. PATENT DOCUMENTS

| | | | | |
|---|---|---|---|---|
| 5,401,186 | A | 3/1995 | Nozaki et al. | |
| 5,934,932 | A * | 8/1999 | Ito | 439/495 |
| 6,089,904 | A * | 7/2000 | Wu | 439/495 |
| 6,210,209 | B1 * | 4/2001 | Wu et al. | 439/495 |
| 6,231,378 | B1 * | 5/2001 | Wu et al. | 439/495 |
| 6,280,240 | B1 * | 8/2001 | Chang | 439/495 |
| 6,475,026 | B1 * | 11/2002 | Tseng et al. | 439/495 |

* cited by examiner

*Primary Examiner*—Hien Vu
(74) *Attorney, Agent, or Firm*—Wei Te Chung

(57) ABSTRACT

An electrical connector (100) for electrically connecting with flexible printed circuit (5, FPC) includes an insulative housing (10), a number of terminals (20) fixed in the housing, a slider (40) for fixing the FPC in the housing and a pair of solder pads (30). The housing includes a tail portion (107). A number of passageways (1071) are defined in the tail portion. Each terminal includes a terminal portion (204) for electrically connecting with cable (6) received in corresponding passageway of the housing.

4 Claims, 6 Drawing Sheets

ELECTRICAL CONNECTOR CONNECTING WITH CABLES

BACKGROUND OF THE INVENTION

1. Field of the Invention

This invention generally relates to an electrical connector and more particularly, to an electrical connector for electrically connecting a flexible printed circuit (FPC) or the like.

2. Description of the Prior Art

Referring to U.S. Pat. No. 5,401,186, the invention discloses a flexible printed circuit (FPC) connector. The conventional connector includes an insulative housing and a plurality of conductive terminals retained in the housing. The terminals interconnect a FPC and a printed circuit board. The connector further includes a slider for mounting the FPC on the housing. However, when the connector connects with cables, firstly the terminals are soldered to the printed circuit board, secondly the cables are soldered to the printed circuit board, thereby electrically connecting with the terminals. Apparently, the terminals are electrically connected with the cables by the printed circuit board. As a result, the connecting process becomes relatively complicated and the cost is relatively high. At the same time, the soldering tin easily floods so that the soldering process becomes relatively difficult.

Hence, an improved electrical connector is needed to overcome the above mentioned deficiencies.

BRIEF SUMMARY OF THE INVENTION

It is an object of the present invention to provide an electrical connector which can conveniently interconnect the FPC and the cables.

In order to attain the object above, an electrical connector for electrically connecting with FPC includes an insulative housing, a plurality of terminals fixed in the housing, a slider for fixing the FPC in the housing and a pair of solder pad. The housing includes a tail portion. A plurality of passageways are defined in the tail portion and spaced apart from each other. Each terminal includes a terminal portion for electrically connecting with cable received in corresponding passageway of the housing.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
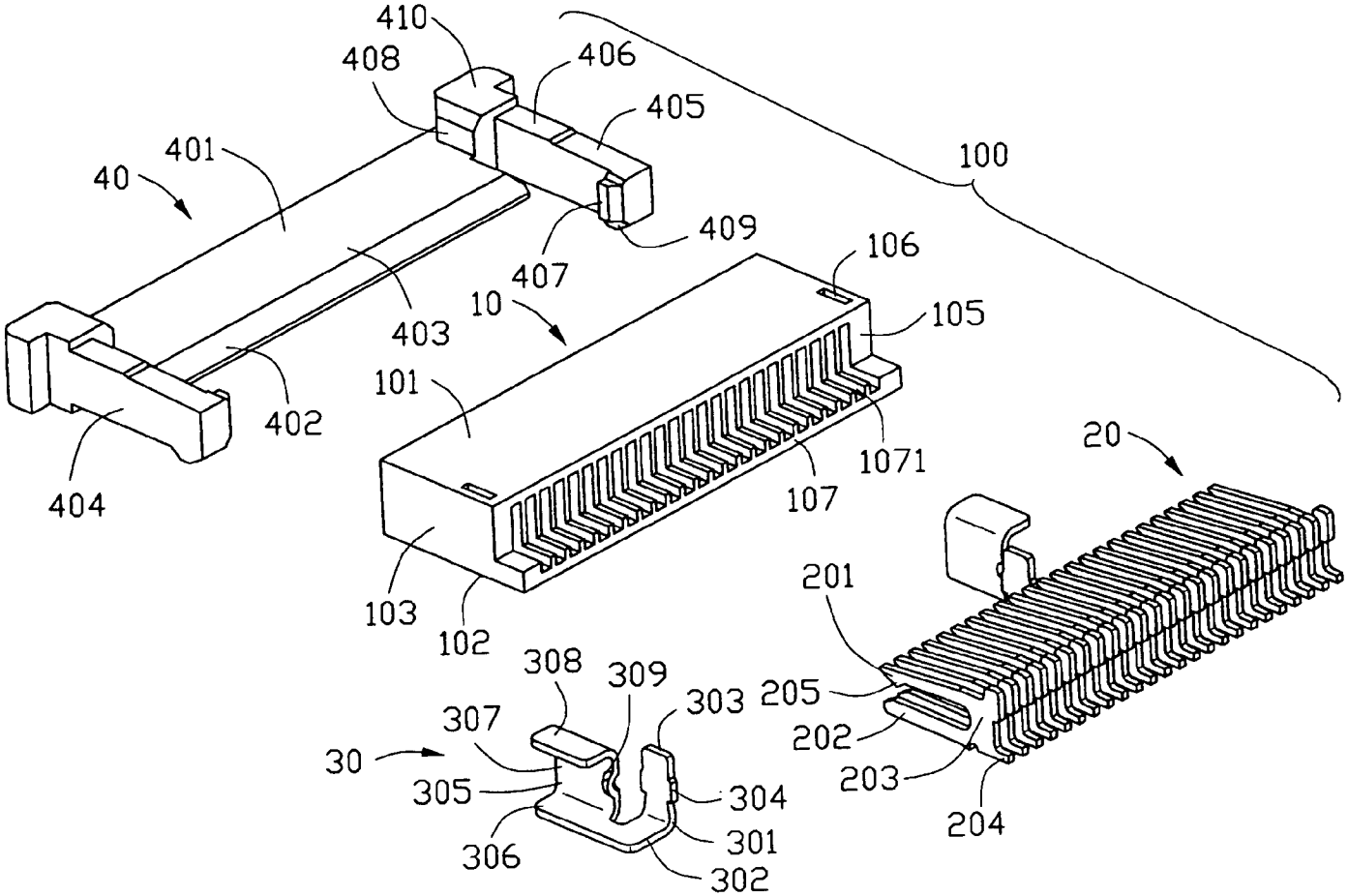
FIG. 1 is an exploded view of an electrical connector according to a first embodiment of the present invention.

Referring to FIG. 1, an electrical connector 100 in accordance with a first embodiment of the present invention includes a substantially rectangular insulative housing 10, a plurality of terminals 20, a pair of solder pads 30 and a slider 40.

Figure 2:
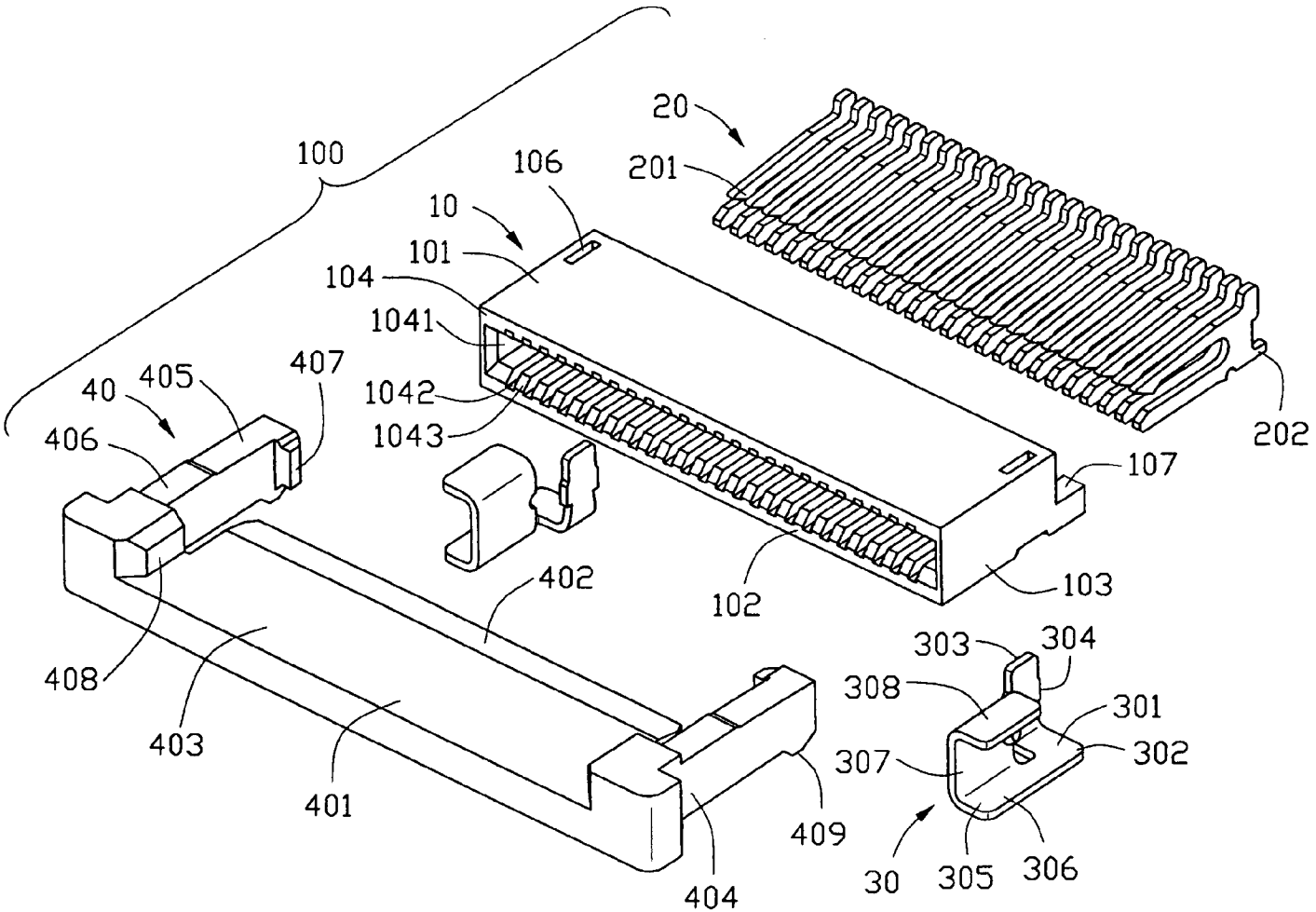
FIG. 2 is another exploded view of the electrical connector of FIG. 1.
Figure 3:
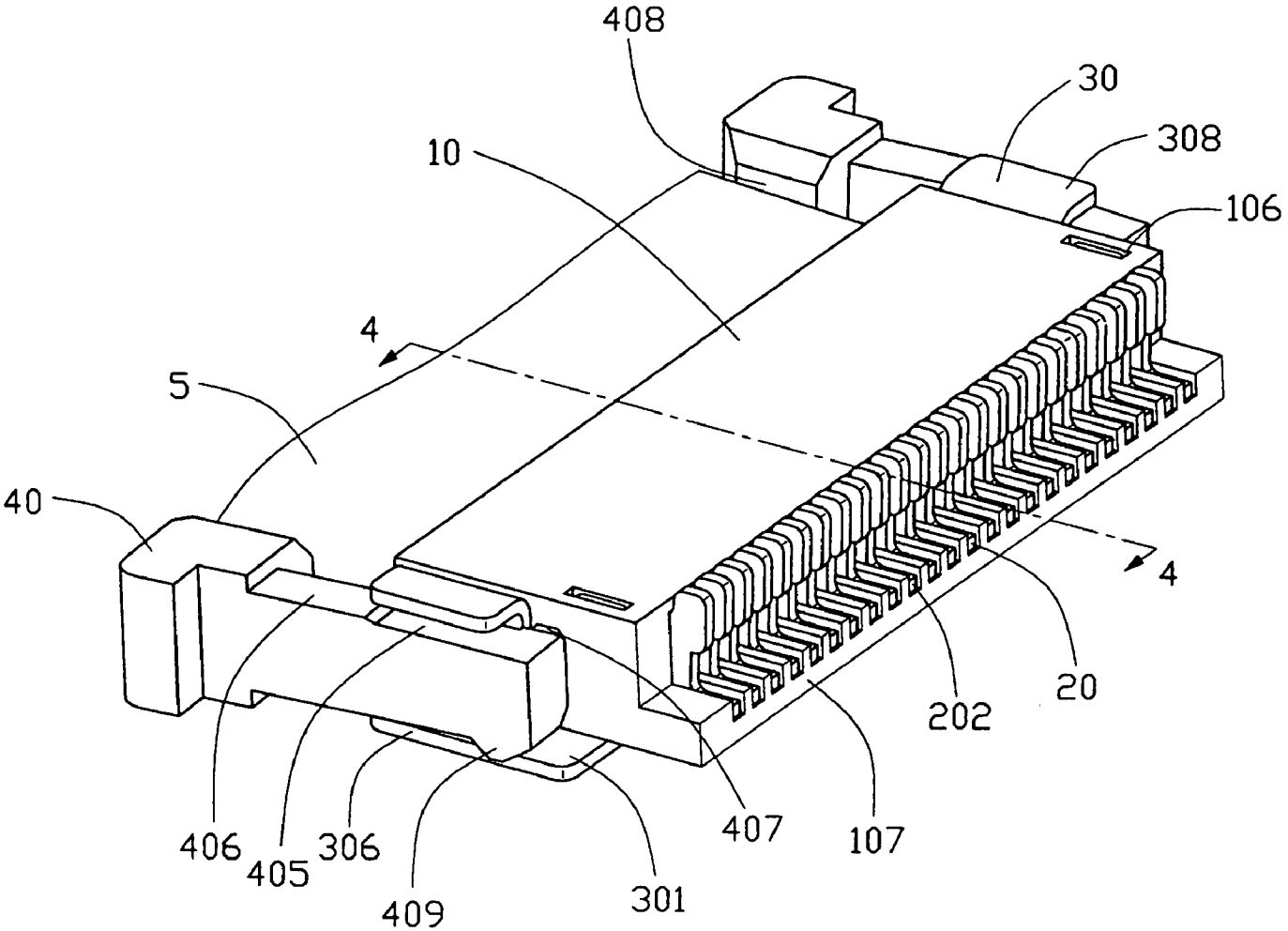
FIG. 3 is an assembled view of FIG. 2, but with a flexible printed circuit partially inserted therein.
Figure 4:
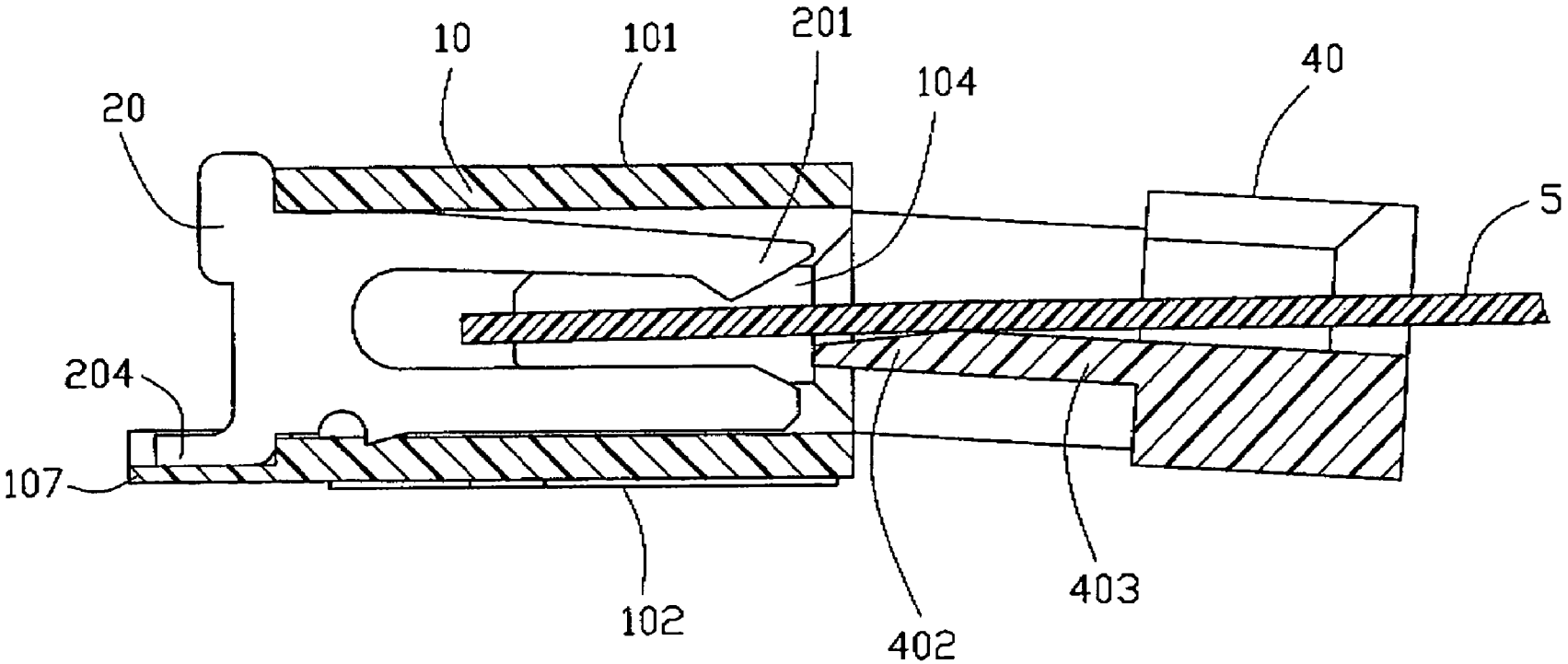
FIG. 4 is a cross sectional view taken along line 4—4 of FIG. 3.
Figure 5:
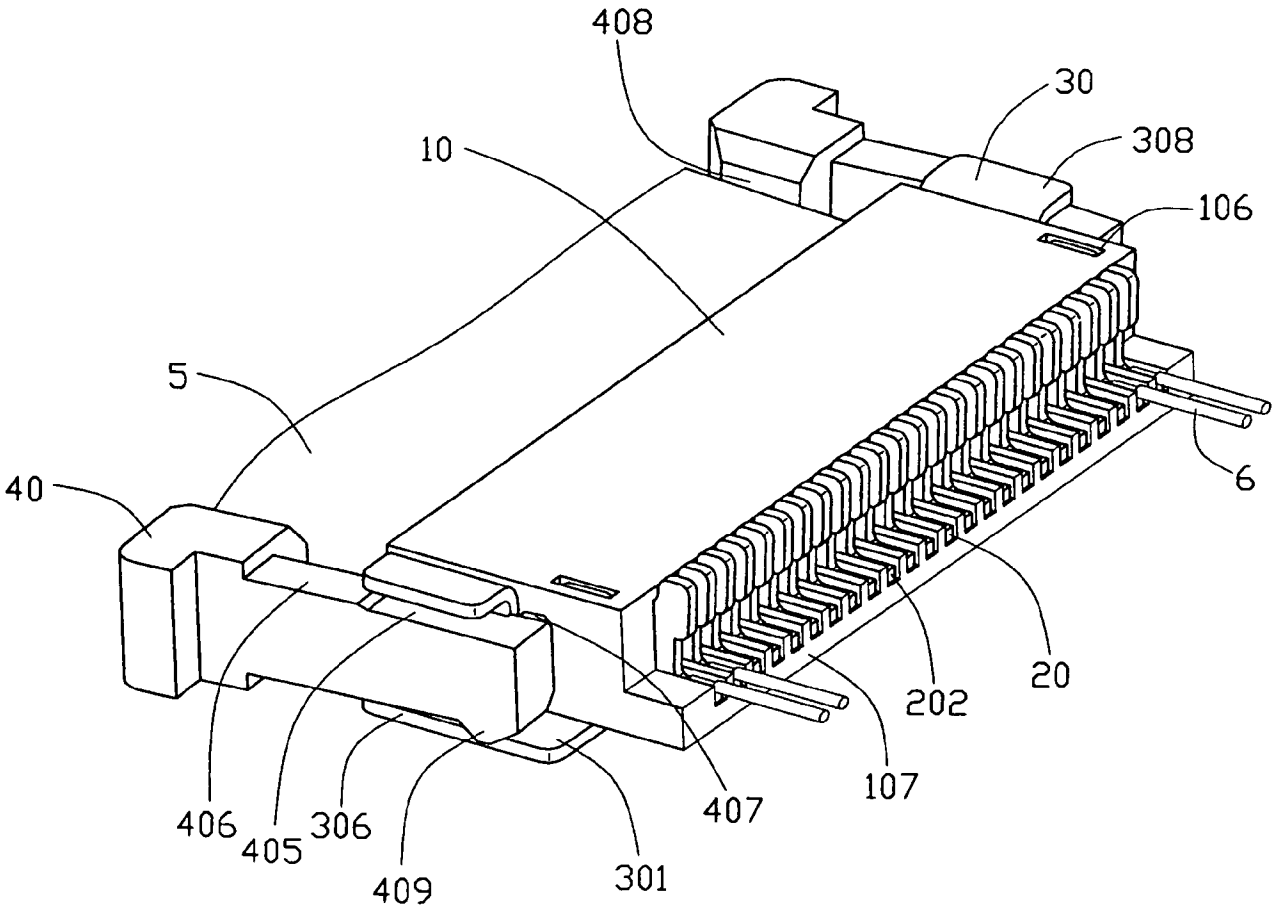
FIG. 5 is a view similar to FIG. 3, but with cables mounted on the electrical connector.

Referring to FIGS. 1–2, the insulative housing 10 includes a body portion (not labeled) and a tail portion 107. The body portion includes an elongate top wall 101 and an elongate bottom wall 102 parallel to each other, a pair of side walls 103, a front wall 104 and a rear wall 105. The tail portion 107 rearward extends from the bottom wall 102. A plurality of passageways 1071 are defined in an upper surface of the tail portion 107. The housing 10 defines a pair of recesses 106 through the top and bottom walls 101, 102. A hollow portion 1041 is defined in the insulative housing 10 through the front wall 104 for receiving an end of a flexible printed circuit 5 (FPC, shown in FIG. 5). A plurality of receiving slots 1042 for receiving corresponding terminals 20 are defined in inner surfaces of the top and rear walls 101, 102 of the housing 10 and separated from one another by partition walls 1043. The receiving slots 1042 through the front and rear walls 104, 105 communicate with the hollow portion 1041 and corresponding passageways 1071.

Each terminal 20 is formed by stamping a metal plate, as shown in FIG. 1. The terminal has an upper finger 201 and a lower finger 202 extending generally parallel to each other from an interconnection portion 203. The fingers 201, 202 and the interconnection portion 203 cooperate to form the generally U-shape terminal 20. A contacting projection 205 projects downwardly from a distal end of the upper finger 201. A terminal portion 204 extends rearward from a lower end of the interconnection portion 203.

The slider 40 is unitarily formed and includes an elongate main body 401, a pair of manual portions 410 on opposite sides of the main body 401 and a arm 404 rearward extending from a rear face of each manual portion 410 for retaining the slider 40 on the housing 10. The main body 401 has a substantially planar pressure plate 403 and an elongate tongue 402 extending rearward from the pressure plate 403. The tongue 402 is shaped with a decreasing thickness toward its rear for facilitating insertion into the hollow portion 1041 of the housing 10. Each manual portion 410 forms a front boss 408 at an inner side thereof. Each arm 404 has a locking portion 406 and a leading portion 405. The locking portion 406 has a top face lower than a top face of the manual portion 410. The leading portion 405 rearward extends from the locking portion 406 and has a top face lower than the top face of the locking portion 406. Each leading portion 405 forms a rear boss 407 at a rear inner surface thereof. A protrusion 409 protrudes downwardly from a distal end of each leading portion 405.

Each slider pad 30 includes a rear part 301 for anchoring onto the housing 10 and a front part 305 for engaging with the arm 404 of the slider 40. The front part 305 is C-shaped and includes a front base 306, a beam 307 perpendicular to the base 306 and a top base 308 parallel to the front base 306 for limiting up-to-down movement of a corresponding arm 404 to be between the front base 306 and a top base 308. A bump 309 is outwardly stamped on a side of the beam 307 adjacent to the rear part 301. The rear part 301 is L-shaped and includes a rear base 302 integrally formed with and lying in a common plane with the front base 306 and a rib 303 vertically and upwardly extending from an edge of the rear base 302. A pair of barbs 304 is provided on two sides of each rib 303 for locking with a corresponding slot 106 of the housing 10. The rib 303 of the rear part 301 is spaced from and is offset relative to the beam 307 of the front part 305.

Referring to FIGS. 1–5, in assembly, firstly the terminals 20 are inserted into the hollow portion 1041 from a rear wall 105 of the housing 10. The upper and lower fingers 201, 202 of the terminals 20 are held in the slots 1042 and the terminal portions 203 are retained in the passageways 1071 of the tail portion 107 of the housing 10. Secondly, the solder pads 30 are mounted on the housing 10. The ribs 303 with barbs 304 of the rear parts 301 of the solder pads 30 are fixed into corresponding recesses 106 of the housing 10, thereby securely fixing the solder pads 30 on the housing 10. The front parts 305 of the solder pads 30 abut against corresponding side walls 103 of the housing 10. Thirdly, the slider 40 is mounted on the housing 10. A rear end of the elongate tongue 402 of the slider 40 is inserted in the hollow portion 1141 of the housing 10. The rear bosses 407 of the slider 40 latch with the bumps 309 of the front parts 305 of the solder pads 30. Finally, the cables 6 are inserted into the passageways 1071 of the tail portion 107 of the housing 10 and are soldered to the terminal portions 204 of the terminals 20, thereby forming an electrical connection between the electrical connector 100 and the cables 6.

In use, the FPC 5 is inserted into the hollow portion 1041 from upper surface of the front wall 104 of the housing 10 pressing rearward the slider 40, with the elongate tongue 402 completely received into the hollow portion 1041 of the housing and the FPC 5 fully inserted into the hollow portion 1141, the pressure plated 403 is partly received in the hollow portion 1041 and biases the FPC 5 against the terminals 20. The front and rear bosses 408, 407 respectively abut against the front wall 104 and the rear wall 105 for preventing release of the FPC 5 from the housing 10. At the same time, the leading portion 405 is received between the upper base 308 and the front base 306, thereby securely mounted the slider 40 on the housing 10. The electrical connector 100 adopts a tail portion 107 for receiving the terminal portion 204 and the cables 6. Therefore, the electrical connector 100 need not electrically connect with the cables 6 by excess printed circuit board. At the same time, the passageways 1071 are spaced apart from each other and prevent the soldering tin from flooding, whereby the soldering process becomes relatively simple.

Figure 6:
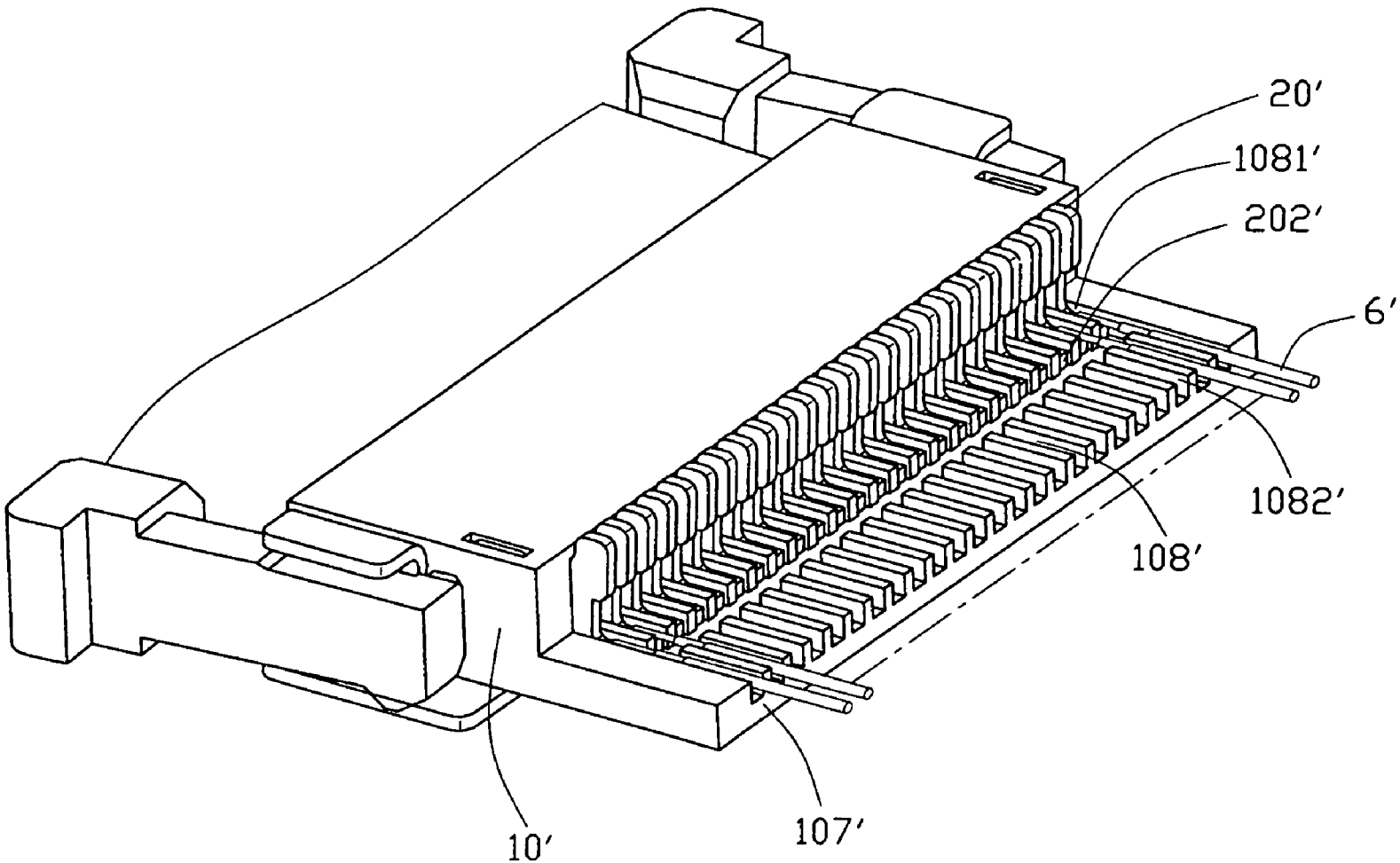
FIG. 6 is an assembled view of the electrical connector according to a second embodiment of the present invention, but with a flexible printed circuit partially inserted and with cables mounted therein.

FIG. 6 is an assembled view of the electrical connector 100 according to a second embodiment of the present invention and shows an electrically connection between the electrical connector 100 and coaxial cables 6'. The insulative housing 10' forms a rearward extending tail portion 107', a plurality of spaced passageways 108' are defined in the tail portion 107'. The passageways 108' includes an array of first passageways 1081' and an array of second passageways 1082' distance from the first passageways 1081'. In assembly, a core conductor of each coaxial cable 6' is received in the first passageway 1081' and are soldered with the terminal portion 202' of the terminal 20', an outer conductor of the coaxial cable 6' is received in the second passageway 1082', at the same time, a braided layer of the coaxial cable 6' can be fastened by a planar fixing plate, thereby forming reliably electrical connections between the electrical connector 100 and the coaxial cables 6'.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mounted on a printed circuit board for electrically connecting a flexible printed circuit with cables, the electrical connector comprising:

an insulative housing including a body portion and a tail portion extending rearward from a bottom wall of the body portion, a plurality of passageways being defined in the tail portion;

a plurality of terminals each including a terminal portion retained in a corresponding passageway of the tail portion of the housing for directly and electrically connecting a cable and a finger fixed in the body portion of the housing for engaging with the flexible printed circuit; the terminal portions of the terminals being separated from the printed circuit board by the tail portion;

a slider movably mounted on the housing for fixing the flexible printed circuit on the fingers of the terminals; and a pair of solder pads for mounting the slider on the insulative housing and soldering the electrical connector to the printed circuit board;

wherein the tail portion is adapted for separating the terminal portions of the terminals from the printed circuit board wherein said passageways include a plurality of first passageways for holding the terminals and a plurality of second passageways for holding the cables therein;

wherein said solder pads each includes a first part for attaching the slider on the housing and a second part engaging with the housing;

wherein the body portion of the housing defines a hollow portion for receiving the flexible printed circuit and a plurality of slots in communication with the hollow portion and corresponding passageways of the tail portion for holding the terminals.

2. The electrical connector according to claim 1, wherein said housing includes a recess, and wherein said second part includes a vertical rib latching into the recess, a pair of barbs being positioned on opposite sides of the rib for securing in the recess of the housing.

3. The electrical connector according to claim 1, wherein said slider includes a main body and a pair of arms being positioned on two sides of the main body, and wherein said arm includes a leading portion and a locking portion, a boss being positioned on the leading portion.

4. The electrical connector according to claim 3, wherein said first part includes a first base and a second base substantially parallel to each other for receiving the locking portion of the slider and a beam substantially perpendicular to the first and second bases, a bump being positioned on the beam for receiving the boss of the leading portion.

* * * * *